US009730496B1

(12) United States Patent
Moreau et al.

(10) Patent No.: US 9,730,496 B1
(45) Date of Patent: Aug. 15, 2017

(54) LANYARD END CONNECTOR

(71) Applicant: Ty-Flot, Inc., Manchester, NH (US)

(72) Inventors: Darrell A. Moreau, Manchester, NH (US); Andre W. Moreau, Bedford, NH (US)

(73) Assignee: Ty-Flot, Inc., Manchester, NH (US)

( * ) Notice: Subject to any disclaimer, the term of this patent is extended or adjusted under 35 U.S.C. 154(b) by 0 days.

(21) Appl. No.: 15/195,228

(22) Filed: Jun. 28, 2016

(51) Int. Cl.
*A45F 5/00* (2006.01)
*A44B 13/00* (2006.01)

(52) U.S. Cl.
CPC ..... *A44B 13/0035* (2013.01); *A45F 5/00* (2013.01); *A45F 2005/006* (2013.01)

(58) Field of Classification Search
CPC ... A44B 13/0035; A45F 5/00; A45F 2005/006
USPC ..... 24/265 R, 265 BC, 265 EC, 3.13
See application file for complete search history.

(56) References Cited

U.S. PATENT DOCUMENTS 967,664 A 8/1910 Peterson
4,455,717 A * 6/1984 Gray ..... F16G 11/14 24/115 M
4,845,585 A 7/1989 Weiss
5,136,756 A 8/1992 Krauss
5,669,119 A 9/1997 Seron
5,671,508 A 9/1997 Murai
5,878,467 A 3/1999 Yokota
6,044,527 A 4/2000 Ishida et al.
6,161,266 A * 12/2000 Anscher ..... A44B 11/266 24/3.6
6,539,588 B1 4/2003 Brosofsky et al.
6,571,434 B2 * 6/2003 Ortiz ..... A44B 11/006 24/265 BC
6,618,910 B1 9/2003 Pontaoe
6,711,785 B1 3/2004 Hicks et al.
6,725,506 B1 4/2004 Anscher
7,013,535 B2 3/2006 Tracy
2013/0205545 A1 * 8/2013 Zantout ..... B65D 63/00 24/16 R
2015/0128384 A1 * 5/2015 Breen, IV ..... B65D 63/1063 24/16 PB

* cited by examiner

*Primary Examiner* — Robert J Sandy
*Assistant Examiner* — Rowland Do
(74) *Attorney, Agent, or Firm* — Robert R. Deleault, Esq.; Mesmer & Deleault, PLLC

(57) ABSTRACT

A lanyard end connector has a connector body and a connector holder. The connector body has a first body end with an enclosed opening adapted for receiving a lanyard end, a second body end having an attachment structure, a central portion defining a connector body frame that delineates a connector body chamber having at least one side window opening, and at least one lanyard tab connected to the connector body frame and adapted for rotatable movement into and away from the at least one side window opening. The connector holder has a holder body with first and second holder end openings and a circumferential holder body wall defining a holder body chamber where the connector body is disposed within the holder body chamber.

20 Claims, 10 Drawing Sheets

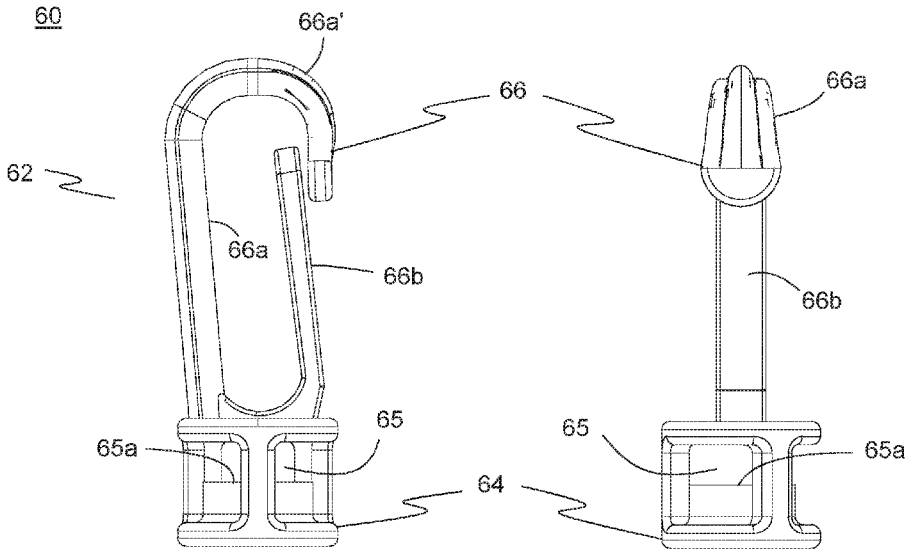
Fig. 5A
Fig. 5B
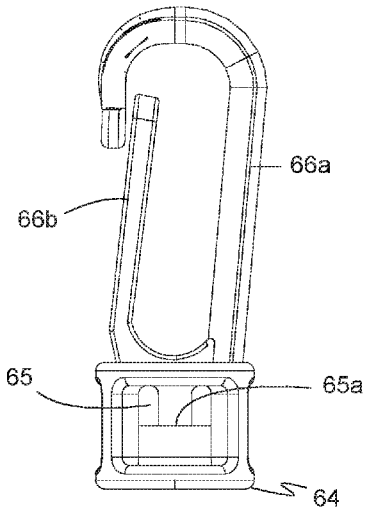
Fig. 5C
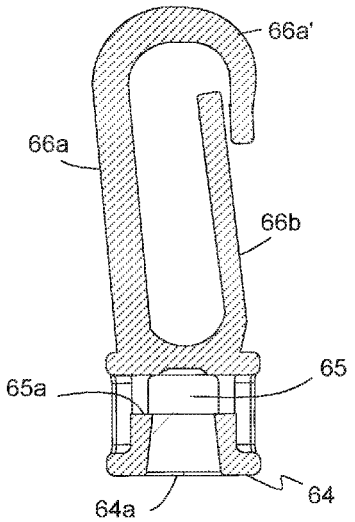
Fig. 5D

Fig. 9A
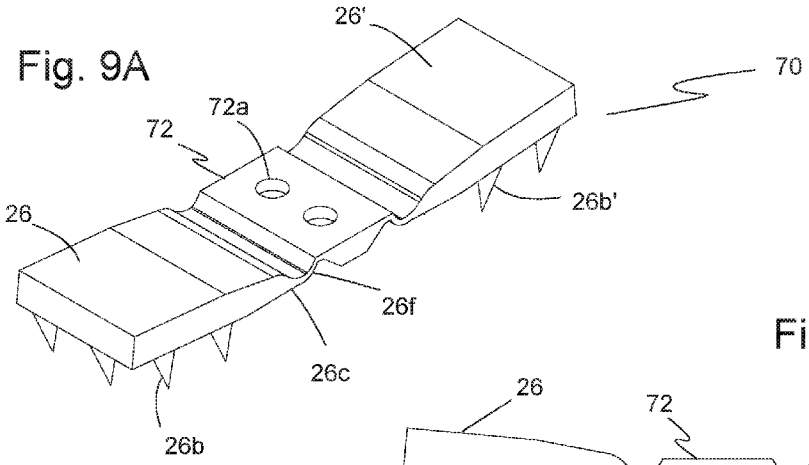
Fig. 9B
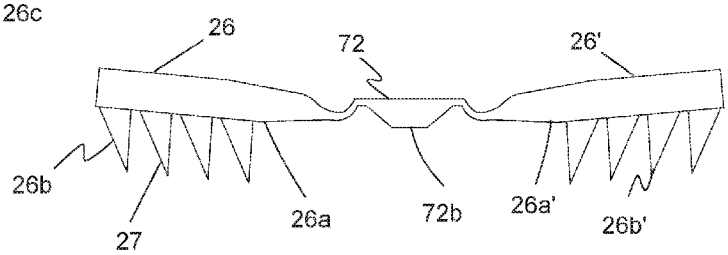
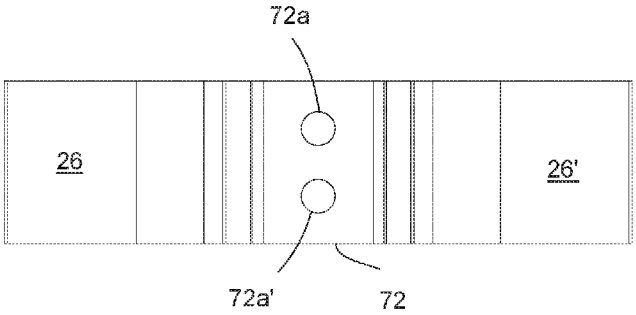
Fig. 9C
Fig. 9D
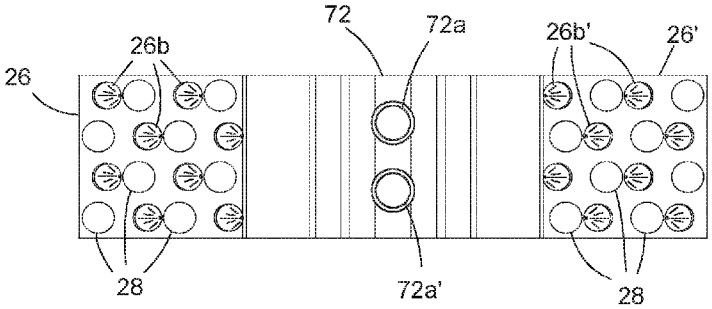

LANYARD END CONNECTOR

BACKGROUND OF THE INVENTION

1. Field of the Invention

The present invention relates generally to lanyards. Particularly, the present invention relates to a lanyard end connector that connects lanyards to one or more attachments.

2. Description of the Prior Art

A lanyard is a cord, strap, line or other such member used to hold or fasten to an object. Lanyards are often worn about the neck of a user for hanging identification badges, writing implements, small tools, and the like. A lanyard connector connects the first and second ends of a lanyard substrate (e.g., a strap or cord) together, forming a closed-loop assembly. A variety of different lanyards and lanyard connectors are presently available within the art.

U.S. Pat. No. 7,031,535 (2006, Tracy) discloses a one-piece clip or web end to join the cord ends of a lanyard. The clip is a foldable, one-piece clip body, the clip body defining an inner surface, an outer surface, and opposing ends. The opposing ends are joined together by a central portion and a pair of hinges, one hinge on each side of the central portion. The central portion includes an aperture and a pair of stabilizing ribs, one on each side of the aperture. Each of the opposing ends on the inner surface has stabilizing rib recesses configured to align with the stabilizing ribs when the clip is folded at the hinges. A plurality of pin pockets extends inwardly from an inside surface of the opposing ends and are positioned in close proximity to a plurality of pins extending outwardly from the inner surface. Each pin has a pin tip where the plurality of pin tips on one end of the opposing ends operatively mate with the plurality of pin pockets on the other end of the opposing ends when the opposing ends are brought together to trap and secure first and second ends of a cord placed therebetween. The opposing ends further including a plurality of locking tabs and recesses for snap fitting together the opposing ends of the foldable clip body when the opposing ends are brought together such that as one or both of the first and second ends of the cord are pulled or placed under an applied tension. Each pin will have a tendency to bend about its respective base until the pin is prevented from bending any further on account of operative interaction with an inner wall of the associated pocket, thereby preventing the ends of the cord from being pulled out of the web under an applied tension. The aperture of the central portion is adapted to receive an attachment for attaching an object to the lanyard.

Therefore, what is needed is a strap and hook system that is attachable to a truck bed and/or anchor point that can securely fasten any cargo to a truck bed. What is also needed is an anchor point adapter that enables the use of conventional tie-down straps for securing low-profile cargo to a truck bed.

SUMMARY OF THE INVENTION

The present invention is directed to a lanyard end connector that receives and captures a lanyard end that cannot be inadvertently or purposely removed easily. Most prior art lanyard end connectors have components forming the body of the connector that snap together typically using side clips on the sides of the components that hold the components together when capturing the lanyard end within the connector. Unfortunately, the design of the connector is such that the snap connections tend to be weak and easily released by simply prying the plastic connector adjacent the snap connections. Further, the snap connections can be easily damaged because of the location of the snap connections relative to the seams of the joined components of the connector.

In the drop-prevention field, however, such a connector can be inadvertently opened since the snap connections can become easily damaged rendering the snap connections ineffective at maintaining the connector components together. The present invention overcomes this problem by positioning the structure that maintains the connector components together within a protective chamber that does not allow easy accessibility to the retaining connections or for the retaining components to be easily damaged.

The present invention achieves these and other objectives by providing a lanyard end connector with locking tabs within a protective chamber.

In one embodiment of the present invention, the lanyard end connector has a connector body and a connector holder. The connector body has a first body end with an enclosed opening adapted for receiving a lanyard end, a second body end having an attachment structure, a central portion defining a connector body frame that delineates a connector body chamber having at least one side window opening, and at least one lanyard tab connected to the connector body frame and adapted for rotatable movement into and away from the at least one side window opening. The at least one lanyard tab has an inside surface facing the connector body chamber where the inside surface has a gripping structure adapted to interface with and capture the lanyard end within the connector body chamber of the connector body frame. The connector body chamber communicates with the enclosed opening in the first body end. The connector holder has a holder body with a first holder end, a second holder end and a circumferential holder body wall. The circumferential holder body wall defines a holder body chamber, a first end opening and a second end opening opposite to the first end opening where the connector body is disposed within the holder body chamber with the first body end extending from the first end opening and the second body end extending from the second end opening.

In another embodiment of the present invention, the lanyard connector includes an attachment component removably attached to the attachment structure of the second body end of the connector body.

In a further embodiment, the connector body has at least one locking tab hingedly attached to an outside surface of the connector frame at a location that is transverse to the at least one side window. The at least one locking tab is adapted for rotatable movement towards and away from the outside surface of the connector frame wherein the at least one locking tab extends outwardly and away from the outside surface of the connector frame when in a relaxed orientation.

In another embodiment, the connector frame has a locking tab groove extending along the connector frame that is adapted to accommodate the at least one locking tab when the locking tab is released from a tensioned orientation.

In yet another embodiment, the connector body has a first body ledge at the first body end that extends transversely from the first body end where the first body ledge has a circumference that is larger than a circumference of the first end opening of the first holder end of the holder body of the connector holder.

In still another embodiment, the holder body of the connector holder has a tab stop disposed in an inside wall surface of the holder body wall adjacent the at least one locking tab and adapted to align with a free end of the at least one locking tab when the at least one locking tab is in the relaxed orientation.

In another embodiment, the gripping structure on the inside surface of the at least one lanyard tab is a plurality of tapered members extending transversely from the inside surface.

In a further embodiment, the connector body has a plurality of recesses in a surface within the connector body chamber opposite the inside surface of the at least one lanyard tab where each of the plurality of recesses is aligned with a corresponding one of the plurality of gripping structures when the gripping structure interfaces with and captures the lanyard end.

In another embodiment, the connector body includes a second lanyard tab attached to the connector body frame and adapted for rotatable movement into and away from a second side window of the connector body frame opposite the at least one side window. The second lanyard tab has an inside surface facing the connector body chamber where in the inside surface of the second lanyard tab has a gripping structure adapted to interface with and capture the lanyard end within the connector body chamber.

In one embodiment, the connector body further includes a second locking tab hingedly attached to the outside surface of the connector frame at a location opposite the at least one locking tab where the second locking tab is adapted for rotatable movement towards and away from the outside surface of the connector frame and where the second locking tab extends outwardly and away from the outside surface of the connector frame when in a relaxed orientation.

In another embodiment, the connector frame has a second locking tab groove extending along the connector frame and adapted to accommodate the second locking tab when the locking tab is forced into a tensioned orientation.

In another embodiment, the gripping structures of the second lanyard tab are a plurality of tapered members extending transversely from the inside surface of the second lanyard tab.

In a further embodiment, the inside surface of the second lanyard tab has a plurality of recesses where each of the plurality of recesses is aligned with a corresponding one of the plurality of gripping structures of the at least one lanyard tab when the gripping structure interfaces with and captures the lanyard end.

In one embodiment, the at least on lanyard tab is directly and hingedly attached to the connector body frame.

In another embodiment, the lanyard end connector includes a lanyard tab assembly having a tab assembly central portion wherein the at least one lanyard tab is directly and hingedly attached to the tab assembly central portion and wherein the tab assembly central portion has at least one tab assembly aperture adapted to receive and be retained by a tab assembly retaining structure disposed within the connector body chamber.

In one embodiment, a method of capturing an end of a lanyard with a lanyard end connector of the present invention is described. The method includes providing a lanyard end connector of the present invention, inserting a lanyard end through the enclosed opening of the first body end of the connector body and into the connector body chamber defined by the connector body frame, rotating into the side window opening of the connector body frame the at least one lanyard tab causing the gripping structure to penetrate into and capture the lanyard end, and sliding the connector holder over the second body end of the connector body and along the connector body frame past the at least one window opening to the first body end thereby retaining the at least one lanyard tab in a lanyard end captured position.

In a further embodiment of the method, the method includes attaching a removable clip structure to the attachment structure at the second body end of the connector body.

In another embodiment of the method, the method includes rotating, before the sliding step, a second lanyard tab rotatably attached to the connector body frame into a second side window opening of the connector body where the second side window opening is opposite the at least one window opening and thereby causing a gripping structure on an inside surface of the second lanyard tab to penetrate into and capture the lanyard end.

In one embodiment of the method, the method further includes providing a lanyard end connector having at least one locking tab hingedly attached to an outside surface of the connector frame at a location that is transverse to the at least one side window where the at least one locking tab extends outwardly and away from the outside surface of the connector frame when in a relaxed orientation and where the at least on locking tab is adapted for rotatable movement towards and away from the outside surface of the connector frame, and where the sliding step includes providing a connector holder with a stop surface disposed in an inside surface of the holder body wall adjacent the at least one locking tab and adapted to align with a free end of the at least one locking tab when the at least one locking tab is in the relaxed orientation, and where, when the connector body is past the at least one window opening and adjacent the first body end, the at least one locking tab is in the relaxed orientation causing the free end of the at least one locking tab to be aligned with the stop surface thereby preventing removal of the connector holder from the connector body.

BRIEF DESCRIPTION OF THE DRAWINGS

FIG. 5A is a front view of one embodiment of an attachment component showing the clip structure of FIG. 2.

FIG. 5B is a left side view of the embodiment of the attachment component of FIG. 5A.

FIG. 5C is a back view of the embodiment of the attachment component of FIG. 5A.

FIG. 5D is a cross-sectional front view of the embodiment of the attachment component of FIG. 5A.

FIG. 9A is a perspective view of one embodiment of a lanyard tab assembly shown in FIG. 7.

FIG. 9B is a side view of the lanyard tab assembly shown in FIG. 9A.

FIG. 9C is a top view of the lanyard tab assembly shown in FIG. 9A.

FIG. 9D is a bottom view of the lanyard tab assembly shown in FIG. 9A.

DETAILED DESCRIPTION

Figure 1:
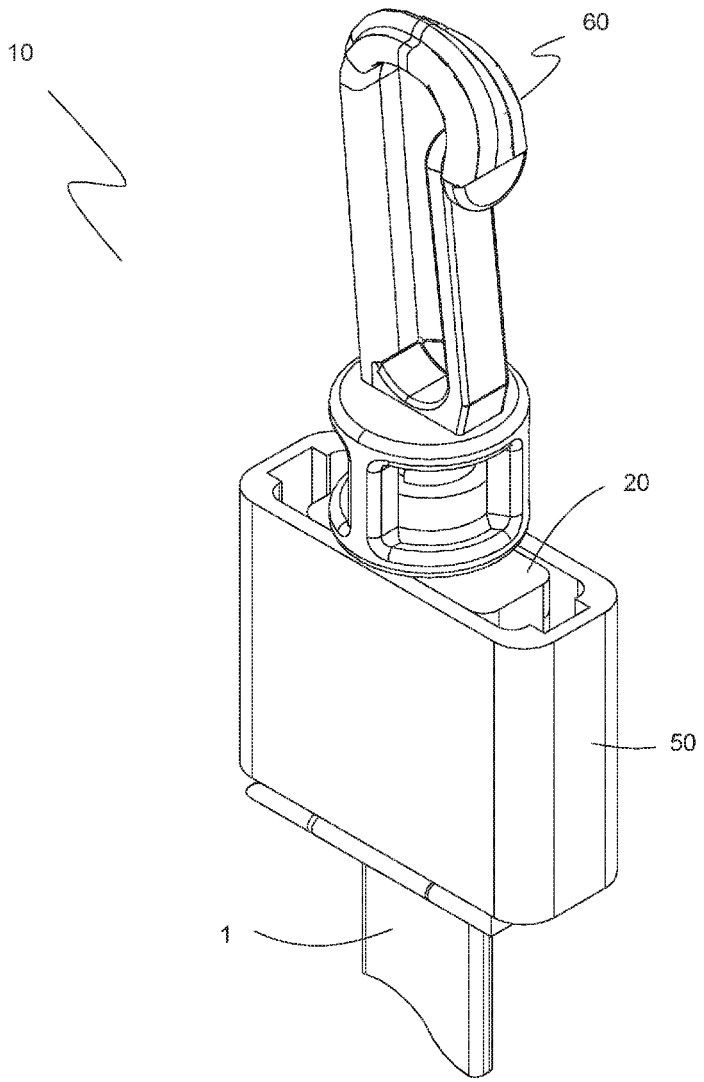
FIG. 1 is a perspective view of one embodiment of the present invention showing a lanyard end connector attached to a lanyard end.

One embodiment of the present invention is illustrated in FIGS. 1-9. FIG. 1 shows one embodiment of a lanyard end connector 10 attached to a lanyard end 1. Lanyard end connector 10 includes a connector body 20, a connector holder 50 disposed around connector body 20, and an optional attachment component 60 connected to connector body 20. In this embodiment, attachment component 60 is an optional clip structure 62. Clip structure 62 is optional because other types of attachment configurations besides clip-type structures may be connected to connector body 20. Attachment component 60 may be removable or rotatable or both. Lanyard end 1 is captured within connector body 20 and not removable once lanyard end connector 10 is assembled to lanyard end 1.

Figure 2:
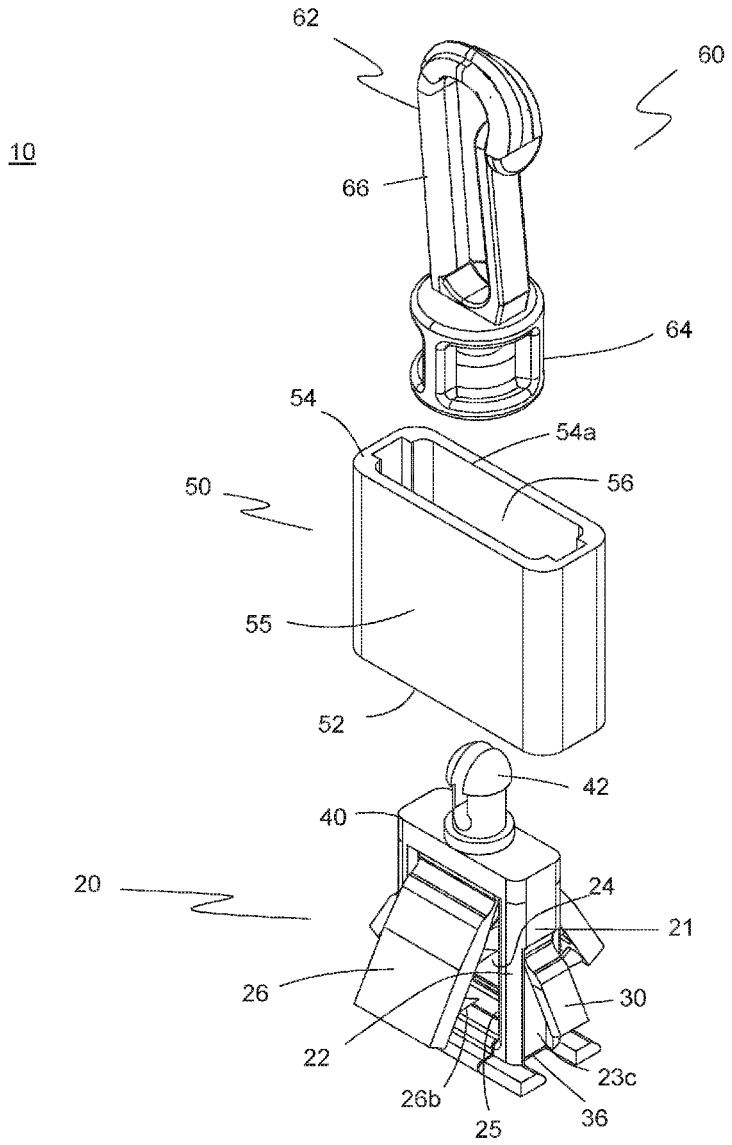
FIG. 2 is a perspective, exploded view of the lanyard end connector of FIG. 1.

FIG. 2 is an exploded view of lanyard end connector 10. Connector body 20 includes a connector body frame 22, a first body end 36 and a second body end 40. Connector body frame 22 has a first frame side 22*a*, a second frame side 22*b* opposite first frame side 22*a*, a first end side 22*c*, and a second end side 22*d* opposite first end side 22*c* that delineates a connector body chamber 24. First frame sides 22*a*, 22*b*, 22*c*, and 22*d* form a longitudinal, rectangular or square shape. Extending transversely and preferably perpendicularly from second body end 40 is an attachment structure 42. First frame side 22*a* has a first side window opening 25 in which is disposed a first lanyard tab 26. First lanyard tab 26 is connected to connector body frame 25 and adapted for rotatable movement into and away from first side window opening 25. In its relaxed state, first lanyard tab 26 is rotatably disposed away from connector body chamber 24 and first side window opening 25. In this embodiment, first lanyard tab 26 is hingedly attached to first frame side 22*a* of connector body frame 25.

First lanyard tab 26 includes a first lanyard tab inside surface 26*a* from which extends a gripping structure 26*b*. First body end 36 has a body end ledge 37 that extends transversely away from first body end 36 and connector body chamber 24 along each of first and second frame sides 22*a*, 22*b* and further extend perpendicularly beyond each of first and second end sides 22*c*, 22*d*. Body end ledge 37 acts as a holder stop for connector holder 50 when connector holder 50 is assembled onto connector body 20.

Connector holder 50 has a holder body 51 with a first holder end 52, a second holder end 54 and a circumferential holder body wall 55. Circumferential holder body wall 55 defines a holder body chamber 56, a first holder end opening 52*a* (not shown) and a second holder end opening 54*a*. When lanyard end connector is assembled, holder body chamber 56 contains connector body frame 22 such that attachment structure 42 of connector body 20 extends from second holder end opening 54*a* away from second holder end 54 and body end ledge 37 extends from first holder end opening 52*a* (best seen in FIGS. 6A-6B).

Optional clip structure 60 includes a clip portion 66 and a clip base portion 64 connected to clip portion 66. Clip base portion 64 is configured to mate with attachment structure 42 of connector body 20.

Figure 3A:
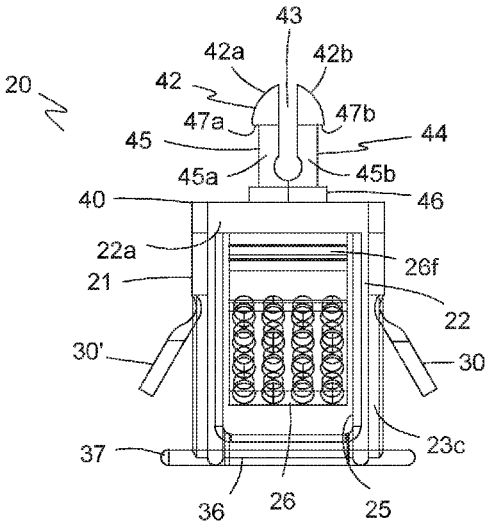
FIG. 3A is a side view of one embodiment of a connector body of the lanyard end connector of FIG. 2.

Turning now to FIGS. 3A to 3D, there is illustrated one embodiment of connector body 20. FIG. 3A illustrates a side view of connector body 20 showing connector body frame 22 looking at first frame side 22*a*. First side window 25 surrounds lanyard tab 26 such that first lanyard tab 26 has sufficient clearance within first side window 25 to allow the hinged rotation of first lanyard tab 26 into and away from first side window 25. First lanyard tab 26 is connected at a first tab edge 26*c* by a flexible hinge 26*f* that is directly connected and adjacent to first frame side 22*a* but spaced from second body end 40. As is more clearly shown in FIG. 3B, first lanyard tab 26 is rotated away from first side window 25 when first lanyard tab 26 is in a relaxed, non-tensioned state or orientation.

Figure 3B:
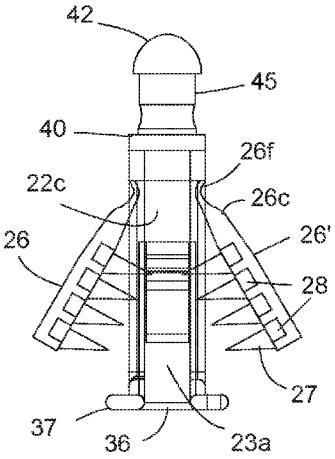
FIG. 3B is an end view of the connector body shown in FIG. 3A.

FIG. 3A also illustrates an optional first holder locking tab 30. Holder locking tab is hingedly attached to first end side 22*c* and rotates into and away from a first end side recess 23*c* formed in first end side 22*c*. First holder locking tab 30 is connected at a first locking tab edge 30*c* by a flexible hinge 30*f* that is connected adjacent to but spaced from second body end 40. As is clearly shown, first holder locking tab 30 is rotated away from first end side recess 23*c* when first holder locking tab 30 is in a relaxed, non-tensioned state or orientation. As can be seen in FIGS. 3A and 3B, body end ledge 37 extends transversely away from a first body end 36 and connector body chamber 24 along each of first and second frame sides 22*a*, 22*b* and further extend perpendicularly beyond each of first and second end sides 22*c*, 22*d*. First body end 36 has an enclosed opening 38 that communicates with connector body chamber 24. Enclosed opening 38 is the entrance port for lanyard end 1.

Figure 3C:
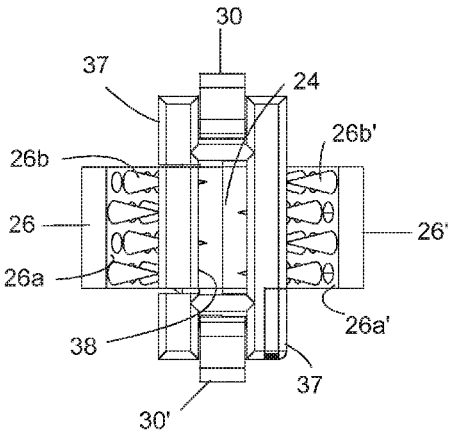
FIG. 3C is a bottom view of the connector body shown in FIG. 3A.
Figure 3D:
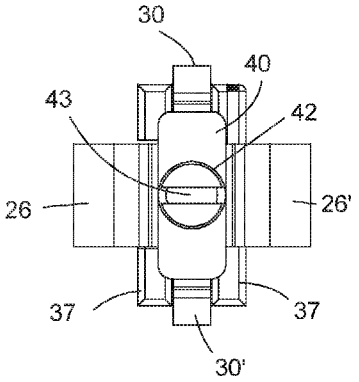
FIG. 3D is a top view of the connector body shown in FIG. 3A.
Figure 4A:
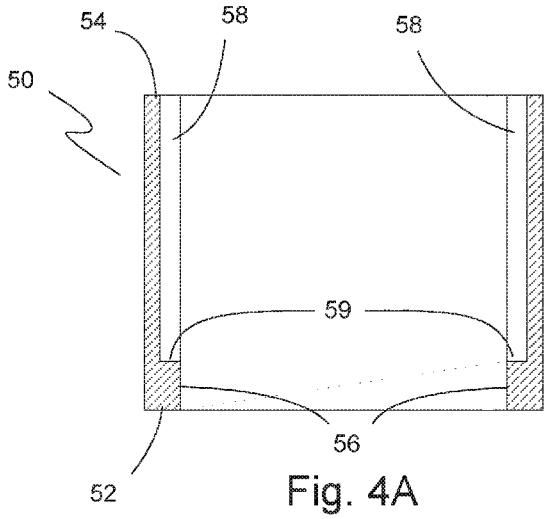
FIG. 4A is a cross-sectional side view of the connector holder shown in FIG. 2.
Figure 4B:
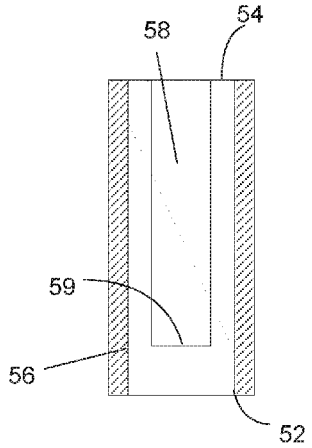
FIG. 4B is a cross-sectional end view of the connector holder shown in FIG. 4A.
Figure 4C:
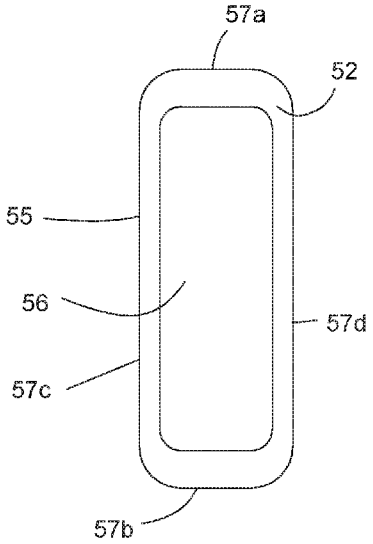
FIG. 4C is a bottom view of the connector holder shown in FIG. 4A.
Figure 4D:
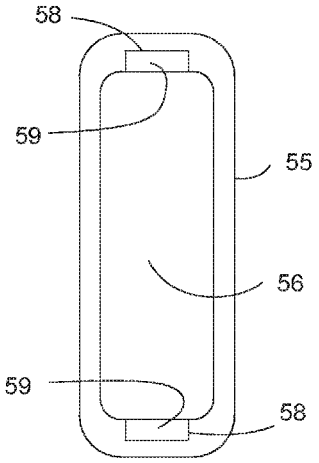
FIG. 4D is a top view of the connector holder shown in FIG. 4A.

FIGS. 3B and 3C illustrate one embodiment of gripping structure 26*b* that extends transversely from lanyard tab inside surface 26*a*. In this embodiment, gripping structure 26*b* has a plurality of gripping components. In this embodiment, the gripping components are a plurality of tapered members 27 that tapers from a wider base portion 27*a* to a narrower end 27*b*. Tapered members 27 may be conically-shaped, pyramidal-shaped or a tapered structure having multiple sides. Gripping structure 26*b* may include a plurality of other gripping components having different structural shapes. The term 'gripping components' also includes shapes such as rounded, oval, square, rectangular, diamond, and the like. The advantage of using tapered members 27 is their ability to penetrate through the lanyard end material to thereby lock the lanyard end material within connector body chamber 24 instead of simply causing the outer surface of the lanyard end material to form a serpentine surface between the gripping structure. A further option includes tapered members 27 having narrower end 27*b* be offset from a center of wider base portion 27*a*. An acceptable and useful offset is the offset having an angle of about 75 degrees from lanyard tab surface 26*a*. The angle is directed toward lanyard tab end 26*c* and second body end 40 so that the tapered surface of tapered members 27 is closer to being 90 degrees to the lanyard tab end 26*c*.

Even though the present invention would function as intended if only a first lanyard tab 26 were used, a second lanyard tab 26' may also be incorporated within connector body 20. To accommodate second lanyard tab 26', connector body frame 22 would also include a second side window opening 25' in second frame side 22*b*. Second lanyard tab 26' would be a mirror-image of first lanyard tab 26 with a gripping structure 26*b*' extending away from a lanyard tab inside surface 26*a*'. The main difference between first lanyard tab 26 and second lanyard tab 26' is that gripping structure 26*b*' is offset from gripping structure 26*b*. In other words, the plurality of gripping components of second lanyard tab 26' are not aligned with the plurality of gripping components of first lanyard tab 26.

First and second lanyard tabs 26, 26' may optionally include a plurality of recesses 28, 28' within first and second lanyard tab inside surfaces 26*a*, 26*a*'. The plurality of recesses 28, 28' are positioned within their respective lanyard tab inside surfaces 26*a*, 26*a*' such that each of gripping structures 26*b*, 26*b*' align with corresponding recesses 28', 28, respectively. In other words, a portion of each one of gripping structures 26*b* of first lanyard tab 26 are received into a corresponding recess of the plurality of recesses 28' of second lanyard tab 26' and vice-versa.

It is also contemplated that, when only first lanyard tab 26 is included in connector body 20, second frame side 22*b* is a second frame side wall 22*b*1 (not shown) having an inside surface 22*b*1*a* (not shown) with or without a plurality of recesses 22*b*1*b* (not shown). If the plurality of recesses 22*b*1*b* are included, then each of the plurality of recesses 22*b*1*b* would align with a corresponding portion of gripping component 26*b* of first lanyard tab 26.

In this embodiment and as shown in FIG. 3A, attachment structure 42 includes integral bulbous distal portions 42*a*, 42*b*, a neck portion 44, a slot 43 between bulbous distal portion 42*a*, 42*b* that extends into neck portion 44, and an attachment structure base portion 46, which is directly connected to second body end 40. Neck portion 44 shown includes a split distal neck 45 extending from the collective, combined bulbous portions 42*a*, 42*b*. Bulbous distal portions 42*a*, 42*b* allow a convenient matching interface with a rotating attachment coupled to neck 44, such that the attachment makes a generally seamless transition with the bulbous distal portions 42*a*, 42*b*.

Split distal neck 45 comprises right and left neck members 45*a*, 45*b* extending individually from attachment structure base portion 46 and spaced apart from each other. Each member 45*a*, 45*b* has a generally semicircular cross section, such that neck 44 overall has a generally circular cross section. The right and left neck members 45*a*, 45*b* collectively form split neck 45 to which an attachment can be selectively coupled and about which an attachment can selectively rotate. In one embodiment, the neck members of split neck 45 can flex inwardly when being mounted within the base of an attachment, then flex outwardly to maintain (e.g., temporarily) the neck within a base of the attachment.

The transition between each neck member 45*a*, 45*b* and bulbous distal portions 42*a*, 42*b*, respective, forms a wider skirt member 47*a*, 47*b*, respectively, extending from neck 44. It will also be appreciated that split neck 45 allows an attachment member to be selectively mounted thereon by pressing at least a portion of an attachment member over the skirted members 47*a*, 47*b*. Skirt members 47*a*, 47*b*, which collectively form a skirt with a generally circular cross section, can at least temporarily prevent the attachment from being moved off the neck 44.

Split neck 45 allows the skirt members 47*a*, 47*b* and bulbous distal portions 42*a*, 42*b* to flex inwardly with respect to each other as the attachment is mounted thereon. After the mounting of the attachment member thereon, as shown for example in FIG. 6A, the skirt members 47*a*, 47*b* and bulbous distal portions 42*a*, 42*b* spring outwardly again, thereby maintaining at least a portion of the attachment rotating about split neck 45*a*, 45*b* between the skirt members 47*a*, 47*b* and base portion 46.

FIGS. 4A to 4D illustrate one embodiment of connector holder 50. As previously described, connector holder 50 has holder body chamber 56 formed by circumferential holder body wall 55 where holder body chamber 56 has first holder end opening 52*a* and second holder end opening 54*a*. In this embodiment, connector holder 50 has a rectangularly-shaped cross-section with holder end walls 57*a*, 57*b* and holder side walls 57*c*, 57*d*. Each of holder end walls 57*a*, 57*b* has an elongated groove 58 that extends from second holder end opening 54*a* along an end wall inside surface 57*a*', 57*b*' to a tab stop 59 adjacent to but spaced from first holder end opening 52*a*.

Turning now to FIGS. 5A to 5D, there is illustrated one embodiment of an optional attachment member 60. In this embodiment, attachment member 60 is a clip structure 62. Clip structure 62 has a clip base portion 64 and a clip portion 66 directly connected to clip base portion 64. Clip portion 66 includes a clip body 66*a* and a bendable clip tab 66*b*. Clip body 66*a* is spaced from clip tab 66*b* at clip base portion 64 and extends away from clip base portion 64. Clip body 66*a* has a J-shaped end 66*a*'. Bendable clip tab 66*b* also extends away from clip base portion 64 towards J-shaped end 66*a*' of clip body 66*a* such that a clip tab end 66*b*' is positioned on an inside of J-shaped end 66*a*'.

Clip base portion 64 of optional clip structure 62 has a base opening 64*a* (shown in FIG. 5D) with base opening walls 64*b* that extends into clip base portion 64 terminating in a clip base portion chamber 65 with a skirt member stop 65*a*. Bulbous distal portions 42*a*, 42*b* reside within clip base portion chamber 65 when clip base portion 64 is attached to attachment structure 42 of connector body 20. Skirt members 47*a*, 47*b* overlap with skirt member stop 65*a* such that bulbous distal portions 42*a*, 42*b* are captured within clip base portion chamber 65, which prevents easy withdrawal of attachment structure 42 from clip base portion 64. Clip base opening 64*a* preferably has base opening walls 64*b* that are tapered providing a tapered, longitudinal cross-section where clip base opening 64*a* narrows (i.e. decreases in diameter) as it extends from clip base bottom 61 and approaches clip base portion chamber 65. The diameter of clip base opening 64*a* at clip base bottom 61 is larger than the diameter of bulbous distal portions 42*a*, 42*b* in the bulbous portions' relaxed state while the diameter of clip base opening 64*a* at clip base portion chamber 65 is smaller than the diameter of bulbous portions 42*a*, 42*b* in the bulbous portions' relaxed state. One advantage of having tapered base opening walls 64*b* within clip base opening 64*a* is it makes assembly of clip structure 62 to connector body 20 easy. Clip base opening 64*a* at clip base bottom 61 is easily aligned onto attachment structure 42 while the tapered clip opening walls 64*b* causes bulbous portions 42*a*, 42*b* to approach each other as clip base bottom 61 approaches second body end 40 of connector body 20. Even though the diameter of clip base opening 64*a* at clip base portion chamber 65 is smaller than the diameter of bulbous portion 42*a*, 42*b*, it has a diameter that is larger than the diameter of bulbous portions 42*a*, 42*b* when bulbous portions 42*a*, 42*b* are squeezed together by tapered base opening walls 64*b* of clip base opening 64*a*. This facilitates attachment of clip structure 60 to attachment structure 42 since bulbous portions 42*a*, 42*b* are squeezed together by clip base opening 64*a* and then allowed to return to their relaxed state once bulbous portions 42*a*, 42*b* enter into clip base portion chamber 65.

Figure 6A:
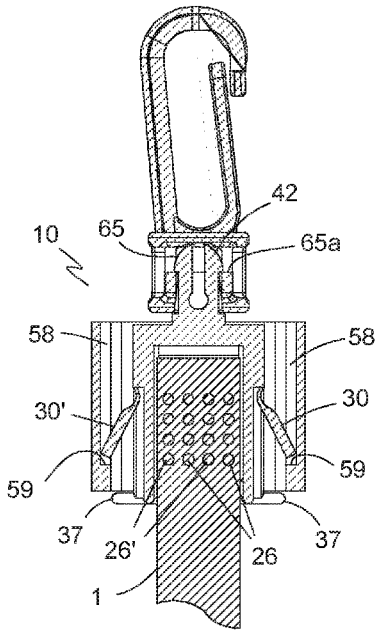
FIG. 6A is a cross-sectional side view of the lanyard connector of FIG. 1 showing the locking tabs in grooves of the connector holder.
Figure 6B:
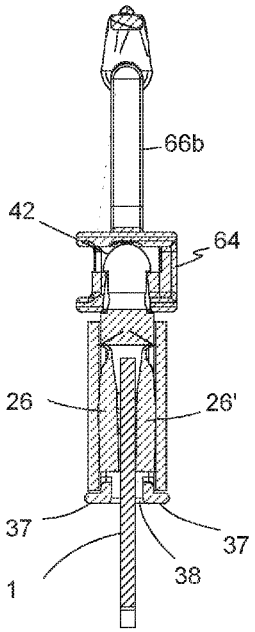
FIG. 6B is a cross-sectional end view of the lanyard end connector of FIG. 1 showing the lanyard tabs in a tensioned and a lanyard end captured orientation.

FIGS. 6A and 6B are cross-sectional views of lanyard end connector 10 showing the relationship of lanyard tabs 26, 26', locking tabs 30, 30', skirt members 47*a*, 47*b*, and skirt member stop 65*a*. In FIG. 6A, which is a cross-sectional side view of lanyard end connector 10 assembled to lanyard end 1, locking tabs 30, 30' are splayed outwardly towards their relaxed state and disposed within the respective grooves 58 in body holder 50. Locking tab stop 59 prevents body holder 50 from sliding up toward second body end 40 of connector body 20 while body ledge 37 prevents body holder 50 from sliding over first body end 36. FIG. 6A also shows the plurality of gripping structures 26*b*, 26*b*' that penetrate into or through lanyard end 1.

FIG. 6B, which is a cross-sectional end view of lanyard end connector 10 assembled to lanyard end 1, shows lanyard tabs 26, 26' maintained in a tensioned position with gripping structures 26*b*, 26*b*' penetrated into or through lanyard end 1 by circumferential wall 51.

Figure 7:
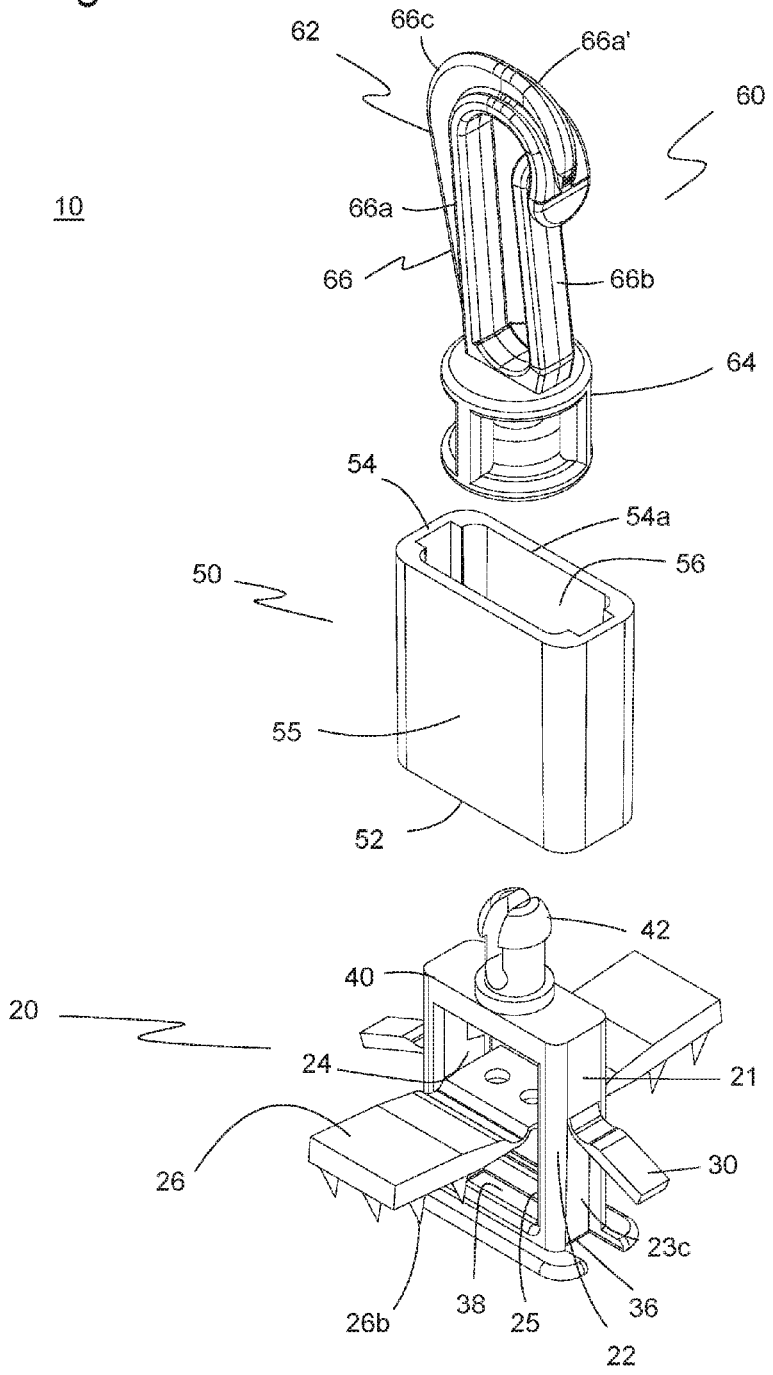
FIG. 7 is a perspective, exploded view of another embodiment of the present invention showing a lanyard connector with a lanyard tab as a separate assembly from the connector body.

Turning now to FIG. 7, there is illustrated another embodiment of lanyard end connector 10. In this embodiment as in the previously described embodiment, lanyard end connector includes a connector body 20, a lanyard tab assembly 70, a connector holder 50, and an optional attachment component 60 adapted for attachment to connector body 20. Attachment member 60 is a clip structure 62 in this embodiment. Clip structure 62 has a clip base portion 64 and a clip portion 66 directly connected to clip base portion 64. Clip portion 66 includes a clip body 66*a* and a bendable clip tab 66*b*. Clip body 66*a* is spaced from clip tab 66*b* at clip base portion 64 and extends away from clip base portion 64. Clip body 66*a* has a J-shaped end 66*a*' and a reinforcing clip body rib 66*c*. Also like in the previously disclosed embodiment, connector body 20 in this embodiment includes a first frame side 22*a*, a second frame side 22*b* opposite first frame side 22*a*, a first end side 22*c*, and a second end side 22*d* opposite first end side 22*c* that delineates a connector body chamber 24. First frame sides 22*a*, 22*b*, 22*c*, and 22*d* form a longitudinal, rectangular or square shape. Extending transversely and preferably perpendicularly from second body end 40 is an attachment structure 42. First frame side 22*a* has a first side window opening 25 in which is disposed a first lanyard tab 26 of lanyard tab assembly 70. First lanyard tab 26 is connected to connector body frame 25 by way of a lanyard tab assembly central portion 72. First lanyard tab 26 is adapted for rotatable movement into and away from first side window opening 25. In its relaxed state, first lanyard tab 26 is rotatably disposed away from connector body chamber 24 and first side window opening 25.

Figure 7A:
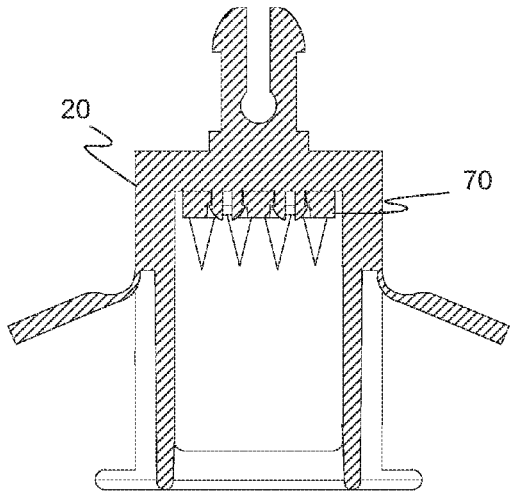
FIG. 7A is a cross-sectional side view of the lanyard connector of FIG. 7 showing the lanyard tab assembly connected to the connector body.
Figure 7B:
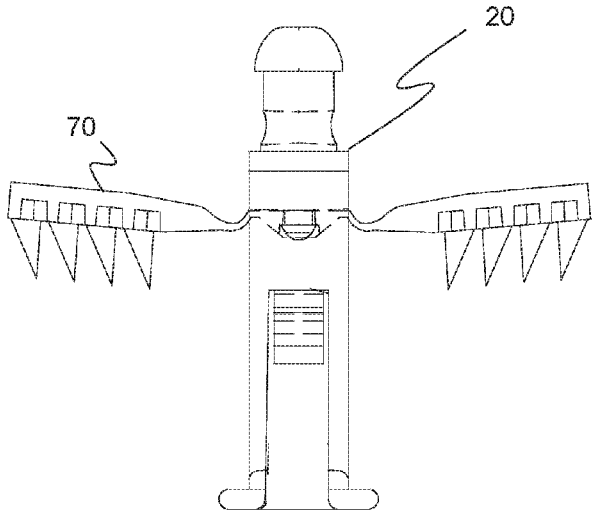
FIG. 7B is a wireframe, end view of the lanyard connector of FIG. 7 showing the lanyard tab assembly connected to the connector body.

FIGS. 7A and 7B show the lanyard tab assembly 70 assembled to connector body 20 with the lanyard tab assembly central portion 72 disposed within the connector body chamber 25 and attached to connector body 20. FIG. 7A is a side cross-sectional view and FIG. 7B is a wireframe end view of the assembly.

Figure 8A:
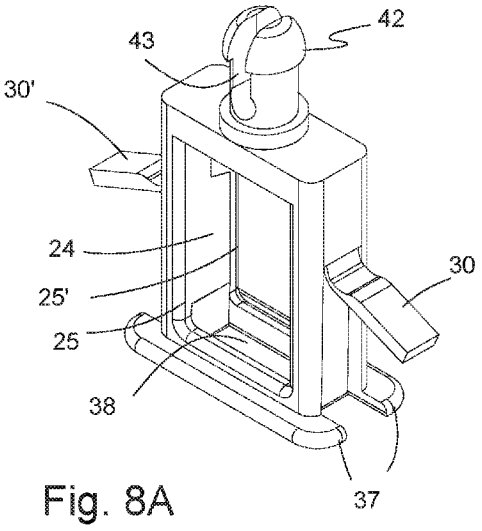
FIG. 8A is a perspective view of the connector body shown in FIG. 7.
Figure 8B:
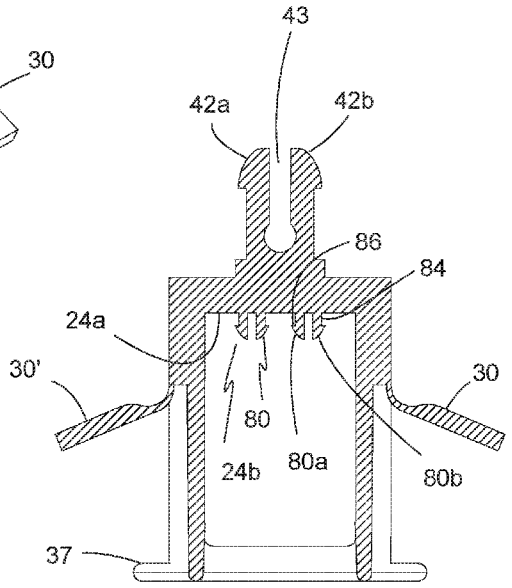
FIG. 8B is a side, cross-sectional view of the connector body illustrated in FIG. 7 showing the lanyard assembly retaining structure.
Figure 8C:
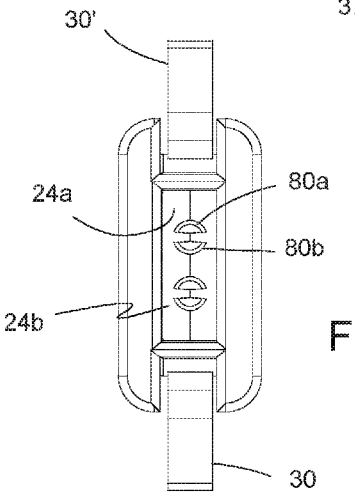
FIG. 8C is a bottom view of the connector body shown in FIG. 7.

FIGS. 8A, 8B and 8C illustrate one embodiment of the connector body 20 shown in FIG. 7. Connector body 20 in this embodiment and as is more clearly shown, includes first frame side 22*a*, second frame side 22*b* opposite first frame side 22*a*, first end side 22*c*, and second end side 22*d* opposite first end side 22*c* that delineates connector body chamber 24. First frame sides 22*a*, 22*b*, 22*c*, and 22*d* form a longitudinal, rectangular or square shape. First frame side 22*a* has a first side window opening 25 and second frame side 22*b* has a second side window opening 25' in which is disposed first lanyard tab 26 and a second lanyard tab 26' of lanyard tab assembly 70 when lanyard tab assembly 70 is assembled to connector body 20. Within connector body chamber 24 at a top chamber wall 24*a* is at least one lanyard tab assembly retaining structure 24*b*. In the embodiment shown, at least one lanyard tab assembly retaining structure 24*b* has a bulbous portion 80 with a tab assembly stop 82. In the illustrated embodiment, bulbous portion 80 includes a pair of bulbous distal portions 80*a*, 80*b* attached to a split neck 84 that has a narrower diameter than the bulbous distal portions 80*a*, 80*b* forming a skirt stop 86.

Turning now to FIGS. 9A to 9D, there is illustrated one embodiment of lanyard tab assembly 70. Lanyard tab assembly 70 includes tab assembly central portion 72 and at least first lanyard tab 26. Tab assembly central portion 72 has at least one central portion aperture 72*a* into which tab assembly retaining structure 24*b* is disposed for retaining tab assembly central portion 72 against and/or adjacent top chamber wall 24*a*. Bulbous portion 80 of tab assembly retaining structure 24*b* extends through the at least one central portion aperture 72*a* so that tab assembly stop 82 abuts against a central portion bottom surface 72*b*. Thus, lanyard tab assembly 70 is connected to connector body frame 25 by way of lanyard tab assembly central portion 72. First lanyard tab 26 is connected at first tab edge 26*c* by flexible hinge 26*f* that is directly connected to lanyard tab assembly central portion 72. As previously discussed, flexible hinge 26*f* is configured to allow first lanyard tab 26 to rotate into and away from first side window opening 25. In its relaxed state, first lanyard tab 26 is rotatably disposed away from connector body chamber 24 and first side window opening 25. First lanyard tab 26 has the same required and optional features as previously disclosed with respect to gripping structure 26*b* that extends transversely from lanyard tab inside surface 26*a*.

In this embodiment of lanyard tab assembly 70, a second lanyard tab 26' is incorporated. second lanyard tab 26' is connected at second tab edge 26*c*' by flexible hinge 26*f*' that is directly connected to lanyard tab assembly central portion 72 along a side generally parallel and opposite to first lanyard tab 26. As previously discussed, flexible hinge 26*f*' is configured to allow second lanyard tab 26' to rotate into and away from second side window opening 25' when lanyard tab assembly 70 is assembled to connector body 20. In its relaxed state and like the first lanyard tab 26, second lanyard tab 26' is rotatably disposed away from connector body chamber 24 and second side window opening 25'. Second lanyard tab 26' like first lanyard tab 26 has the same required and optional features as previously disclosed with respect to gripping structure 26*b* that extends transversely from lanyard tab inside surface 26*a*.

A method of capturing an end of a lanyard within a lanyard end connector will now be explained. The method begins by providing to a user a lanyard end connector 10 having at least a connector body 20 and a connector holder 50. The user inserts a lanyard end 1 through the enclosed opening 38 of first body end 36 of connector body 20 and into connector body chamber 24. Next, the user slides connector holder 50 over the second body end 40 of connector body 20 and along the connector body frame 22 past window opening 25 to first body end 36. The sliding action causes the lanyard tab 26 to rotate toward and into window side opening 25 where the plurality of gripping structures 26*b* penetrate into or through lanyard end 1 capturing lanyard end 1 within the connector body chamber 24.

In embodiments where a locking tab 30 is incorporated into connector body 20, simultaneous with the rotating of the lanyard tab 26 into window side opening 25, connector holder 50 causes locking tab 30 to rotate from its relaxed state into first side recess 23*c* and a tensioned state. Once connector holder 50 reaches its end position on connector body 20, locking tab 30 generally and simultaneously aligns with holder body groove 58 allowing locking tab 30 to be released from its tensioned state towards its relaxed state. This action positions locking tab 30 adjacent locking tab stop 59, which prevents removal of connector holder 50 in a reverse direction and effectively maintains lanyard end connector 10 and lanyard end 1 in an assembled state. In the embodiment having a lanyard tab assembly 70, connector body 20 may have lanyard tab assembly 70 already mounted within connector body chamber 24 so that tab assembly central portion 72 is captured by tab assembly retaining structure 24*b*, or it may require one to assemble lanyard tab assembly 70 to tab assembly retainer structure 24*b*.

There are many advantages of the present invention over similar prior art devices. The present invention prevents inadvertent or purposeful release of the lanyard connector 10 from lanyard end 1. One of the reasons is that neither the lanyard tab 26 nor the locking tab 30 is exposed and accessible to be inadvertently or deliberately tampered with.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A lanyard end connector comprising:

a connector body having a first body end with an enclosed opening adapted for receiving a lanyard end, a second body end having an attachment structure, a central portion defining a connector body frame that delineates a connector body chamber having at least one side window opening, and at least one lanyard tab connected to the connector body frame and adapted for rotatable movement into and away from the at least one side window opening, the at least one lanyard tab having an inside surface facing the connector body chamber wherein the inside surface has a gripping structure adapted to interface with and capture the lanyard end within the connector body chamber of the connector body frame, the connector body chamber communicating with the opening in the first body end; and a connector holder having a holder body with a first holder end, a second holder end and a circumferential holder body wall, the circumferential holder body wall defining a holder body chamber, a first end opening and a second end opening opposite to the first end opening wherein the connector body is disposed within the holder body chamber with the first body end extending from the first end opening and the second body end extending from the second end opening.

2. The connector of claim 1 further comprising an attachment component removably attached to the attachment structure of the second body end of the connector body.

3. The connector of claim 1 wherein the connector body further comprising at least one locking tab hingedly attached to an outside surface of the connector frame at a location that is transverse to the at least one side window, the at least one locking tab adapted for rotatable movement towards and away from the outside surface of the connector frame wherein the at least one locking tab extends outwardly and away from the outside surface of the connector frame when in a relaxed orientation.

4. The connector of claim 3 wherein the connector frame has a locking tab groove extending along the connector frame adapted to accommodate the at least one locking tab when the locking tab is released from a tensioned orientation.

5. The connector of claim 3 wherein the holder body of the connector holder has a tab stop disposed in an inside wall surface of the holder body wall adjacent the at least one locking tab and adapted to align with a free end of the at least one locking tab when the at least one locking tab is in the relaxed orientation.

6. The connector of claim 3 wherein the connector body further comprising a second locking tab hingedly attached to the outside surface of the connector frame at a location opposite the at least one locking tab wherein the second locking tab is adapted for rotatable movement towards and away from the outside surface of the connector frame and wherein the second locking tab extends outwardly and away from the outside surface of the connector frame when in a relaxed orientation.

7. The connector of claim 6 wherein the connector frame has a second locking tab groove extending along the connector frame and adapted to accommodate the second locking tab when the locking tab is forced into a tensioned orientation.

8. The connector of claim 1 wherein the first body end has a first body ledge that extends transversely from the first body end wherein the first body ledge has a circumference that is larger than a circumference of the first end opening of the first holder end of the holder body of the connector holder.

9. The connector of claim 1 wherein the gripping structure on the inside surface of the at least one lanyard tab is a plurality of tapered members extending transversely from the inside surface.

10. The connector of claim 1 further comprising a plurality of recesses in a surface within the connector body chamber opposite the inside surface of the at least one lanyard tab wherein each of the plurality of recesses is aligned with a corresponding one of the plurality of gripping structures when the gripping structure interfaces with and captures the lanyard end.

11. The connector of claim 1 wherein the connector body further comprising a second lanyard tab connected to the connector body frame and adapted for rotatable movement into and away from a second side window of the connector body frame opposite the at least one side window, the second lanyard tab having an inside surface facing the connector body chamber where in the inside surface of the second lanyard tab has a gripping structure adapted to interface with and capture the lanyard end within the connector body chamber.

12. The connector of claim 11 wherein each of the inside surface of the at least one lanyard tab and the inside surface of the second lanyard tab have a plurality of recesses wherein each of the plurality of recesses are aligned for receiving a corresponding one of the plurality of gripping structures of the other one of the at least one lanyard tab or the second lanyard tab, respectively.

13. The connector of claim 11 wherein the gripping structure on the inside surface of the second lanyard tab is a plurality of tapered members extending transversely from the inside surface.

14. The connector of claim 13 further comprising a plurality of recesses in a surface of the second lanyard tab wherein each of the plurality of recesses is aligned with a corresponding one of the plurality of gripping structures of the at least one lanyard tab when the gripping structure interfaces with and captures the lanyard end.

15. The connector of claim 1 wherein the at least one lanyard tab is directly and hingedly attached to the connector body frame.

16. The connector of claim 1 further comprising a lanyard tab assembly having a tab assembly central portion wherein the at least one lanyard tab is directly and hingedly attached to the tab assembly central portion and wherein the tab assembly central portion has at least one tab assembly aperture adapted to receive and be retained by a tab assembly retaining structure disposed within the connector body chamber.

17. A method of capturing an end of a lanyard within the lanyard end connector of claim 1, the method comprising:

providing the lanyard end connector of claim 1;

inserting a lanyard end through the enclosed opening of the first body end of the connector body and into the connector body chamber defined by the connector body frame;

rotating into the side window opening of the connector body frame the at least one lanyard tab causing the gripping structure to penetrate into and capture the lanyard end; and sliding the connector holder over the second body end of the connector body and along the connector body frame past the at least one window opening to the first body end thereby retaining the at least one lanyard tab in a lanyard end captured position.

18. The method of claim 17 further comprising attaching a removable clip structure to the attachment structure at the second body end of the connector body.

19. The method of claim 17 further comprising rotating, before the sliding step, a second lanyard tab rotatably attached to the connector body frame into a second side window opening of the connector body wherein the second side window opening is opposite the at least one window opening and thereby causing a gripping structure on an inside surface of the second lanyard tab to penetrate into and capture the lanyard end.

20. The method of claim 17 wherein the providing step includes providing a lanyard end connector having at least one locking tab hingedly attached to an outside surface of the connector frame at a location that is transverse to the at least one side window wherein the at least one locking tab extends outwardly and away from the outside surface of the connector frame when in a relaxed orientation and wherein the at least on locking tab is adapted for rotatable movement towards and away from the outside surface of the connector frame;

wherein the sliding step includes providing a connector holder with a stop surface disposed in an inside surface of the holder body wall adjacent the at least one locking tab and adapted to align with a free end of the at least one locking tab when the at least one locking tab is in the relaxed orientation; and wherein, when the connector body is past the at least one window opening and adjacent the first body end, the at least one locking tab is in the relaxed orientation causing the free end of the at least one locking tab to be aligned with the stop surface thereby preventing removal of the connector holder from the connector body.

* * * * *